US006860908B2

(12) United States Patent
Vassilakis et al.

(10) Patent No.: US 6,860,908 B2
(45) Date of Patent: Mar. 1, 2005

(54) PETROLEUM MIDDLE DISTILLATE COMPOSITION CONTAINING A SUBSTANCE FOR LIMITING THE PARAFFIN SEDIMENTATION RATE

(75) Inventors: Despina Vassilakis, Lyons (FR); Robert Leger, Taluyers (FR); Alain Forestiere, Vernaison (FR); Jean Gaillard, Saint Martin d'Heres (FR)

(73) Assignee: Institut Francais du Pétrole, Rueil-Malmaison (FR)

( * ) Notice: Subject to any disclaimer, the term of this patent is extended or adjusted under 35 U.S.C. 154(b) by 0 days.

(21) Appl. No.: 09/963,040

(22) Filed: Sep. 26, 2001

(65) Prior Publication Data

US 2002/0053160 A1 May 9, 2002

Related U.S. Application Data

(63) Continuation of application No. 08/454,372, filed on Jun. 16, 1995, now abandoned.

(30) Foreign Application Priority Data

Dec. 17, 1992 (FR) ..... 92 15358

(51) Int. Cl.[7] ..... C10L 1/18; C10L 1/22
(52) U.S. Cl. ..... 44/331
(58) Field of Search ..... 44/331, 348, 389, 44/403, 407

(56) References Cited

U.S. PATENT DOCUMENTS

| | | | |
|---|---|---|---|
| 2,638,450 | A | 5/1953 | White |
| 3,068,082 | A | 12/1962 | Paris |
| 3,920,698 | A | 11/1975 | Haemmerle |
| 4,367,074 | A | 1/1983 | Maldonado |
| 4,652,273 | A | 3/1987 | Maldonado |
| 4,976,746 | A | 12/1990 | Denis |

FOREIGN PATENT DOCUMENTS

| | | |
|---|---|---|
| EP | 0071513 | 2/1983 |
| EP | 0299119 | 1/1989 |
| EP | 0353116 | 1/1990 |
| FR | 1197418 | 12/1959 |
| FR | 2490669 | 3/1982 |
| FR | 2539754 | 7/1984 |
| FR | 2576032 | 7/1986 |

*Primary Examiner*—Cephia D. Toomer
(74) *Attorney, Agent, or Firm*—Millen, White, Zelano & Branigan, P.C.

(57) ABSTRACT

A middle petroleum distillate composition containing a major proportion of middle petroleum distillate and a minor proportion of an additive in a sufficient amount to limit the settling speed of paraffins contained in said middle distillate. Said additive consists of a product resulting from a reaction between at least one aliphatic dicarboxylic compound and at least one primary amine functional compound of general formula (I), wherein $R^1$ is a monovalent saturated aliphatic radical, Z is selected from —NR'— groupings in which R' is a hydrogen atom or a monovalent saturated aliphatic radical, n is an integer between 2 and 4, and m is an integer between 1 and 4; said primary amine functional compound being used in a ratio of 0.3–0.8 mols per mol of said dicarboxylic compound.

$$R^1-Z-[(CH_2)_n-NH]_m-H \quad (I)$$

15 Claims, No Drawings

PETROLEUM MIDDLE DISTILLATE COMPOSITION CONTAINING A SUBSTANCE FOR LIMITING THE PARAFFIN SEDIMENTATION RATE

This application is a continuation of U.S. application Ser. No. 08/454,372, filed Jun. 16, 1995, now abandoned.

The invention concerns middle distillates of hydrocarbons (fuel oils, gas oils), in which paraffin decantation is retarded by the addition of nitrogen-containing additives. It also concerns a method of reducing the settling or sedimentation of paraffins in a hydrocarbon middle distillate by the addition of a minor proportion of at least one nitrogen-containing agent.

The petroleum distillates involved in the invention consist of middle distillates (fuel oils, gas oils) containing paraffins with a distillation range (ASTM D 86–67) of between 150° C. and 450° C. More particularly, the gas oils under consideration have a distillation range from an initial boiling point of between 160° C. and 190° C. to a cut point of between 350° C. and 390° C.

A large number of products are available which are used to improve the limiting filter temperature and the pour point of paraffin-rich petroleum cuts. Examples are:

polymers based on long chain olefins;

alpha-olefin based copolymers;

vinyl acetate-ethylene copolymers;

N-acylaminoethyl esters of acid-containing polymers; or halocarbon compounds.

These products affect the kinetics of crystallisation and modify the crystal size, meaning that the suspension can be used at a lower temperature without clogging conduits and filters.

Other additives are available which reduce the cloud point of petroleum cuts by modifying the temperature at which the first paraffin crystals appear.

Reducing the cloud point of middle distillates (in particular gas oils) using an additive is important for refiners as it means that the distillation process does not need to be modified to satisfy regulations which are now becoming more and more severe.

In addition, when paraffin crystals are formed on cooling, their natural tendency is to collect under gravity at the lowest point. This phenomenon, generally known as sedimentation, blocks conduits and filters and impairs the use of middle distillates, in particular gas oils, at low temperatures.

The class of chemical compounds described in European patent EP-B-0 071 513 as additives for reducing the cloud point in hydrocarbon middle distillates and substantially affecting the limiting filter temperature and pour point are also described as having an effect on the sedimentation rate of paraffins formed by cooling gas oils and other middle distillates.

The additives considered in the present application and defined below are close to those described in EP-B-0 071 513 and belong to the same class of chemical compounds. We have surprisingly discovered that, in the class of chemical compounds described generically in EP-B-0 071 513, certain of these compounds, which were not described in that document, exhibit far superior properties as regards their effect on the paraffin sedimentation rate and were more efficient anti-sedimentation additives under more severe test conditions.

Finally, the products recommended in the present invention for their anti-sedimentation properties as mentioned above, also provide gas oils and other middle distillates to which they are added with anti-corrosive properties in contact with metallic surfaces.

In general, petroleum middle distillate compositions of the present invention are defined as comprising a major proportion of middle petroleum distillate and a minor proportion, which is sufficient to limit the sedimentation rate of the paraffins it contains, of at least one additive consisting of a product with an average molecular weight of about 300 to 10000 resulting from the reaction of at least one aliphatic dicarboxylic compound selected from maleic and alkylmaleic anhydrides, alkenyl succinic anhydrides containing 10 to 32 carbon atoms in the alkenyl radical, and the corresponding dicarboxylic acids and lower alkyl diesters, and at least one primary amine with general formula (I):

$$R^1—Z—[(CH_2)_n—NH]_m—H$$

where $R^1$ represents a monovalent saturated aliphatic radical containing 1 to 32 carbon atoms, Z is selected from the groups —NR'— where R' represents a hydrogen atom or a monovalent saturated aliphatic radical containing 1 to 32 carbon atoms, n is a whole number from 2 to 4, and m is a whole number from 1 to 4; said primary amine being used in a proportion of 0.3 to 0.8 moles per mole of said dicarboxylic compound and said reaction being carried out at a temperature of 120° C. to 200° C., and being continued until all the volatile products consisting of water and/or alcohol formed during the reaction have evolved. Most often, the reaction is continued for a sufficient time to allow the theoretical quantity of volatile products consisting of water and/or alcohol to form. They are then eliminated.

The present invention also concerns a method of reducing the sedimentation rate of paraffins contained in a hydrocarbon mixture, comprising introducing into the hydrocarbon mixture a minor quantity, sufficient to reduce the paraffin sedimentation rate, of at least one additive consisting of a product with an average molecular weight of about 300 to 10000 resulting from the reaction of at least one aliphatic dicarboxylic compound selected from maleic and alkylmaleic anhydrides, alkenyl succinic anhydrides containing 10 to 30 carbon atoms in the alkenyl radical, and the corresponding dicarboxylic acids and lower alkyl diesters, and at least one primary amine with general formula (I):

$$R^1—Z—[(CH_2)_n—NH]_m—H$$

where Z, $R^1$, n and m have the definitions given above, said primary amine being used in a proportion of 0.3 to 0.8 moles per mole of said dicarboxylic compound and said reaction being carried out at a temperature of 120° C. to 200° C., and being continued until all the volatile products consisting of water and/or alcohol formed during the reaction have evolved.

Compounds with formula (I) can be polyamines derived from saturated aliphatic amines with formula:

$$R^1—NH—[(CH_2)_n—NH]_m—H$$

which corresponds to general formula (I) where Z represents the group —NH—; m is 1 to 4 and n is 2 to 4; preferably, m is 2 to 4 and n equals 3; $R^1$ is preferably a linear monovalent saturated aliphatic radical containing 12 to 32 carbon atoms, more particularly 16 to 24 carbon atoms.

Specific compounds are: N-dodecyl 1,3-diaminopropane, N-tetradecyl 1,3-diaminopropane, N-hexadecyl 1,3-diaminopropane, N-octadecyl 1,3-diaminopropane, N-eicosyl 1,3-diaminopropane, N-docosyl 1,3-diaminopropane, N-hexadecyl dipropylene triamine, N-octadecyl dipropylene triamine, N-eicosyl dipropylene triamine and N-docosyl dipropylene triamine. More advantageously, the following compounds are used: N-docosyl-, N-eicosyl-, N-octadecyl-, N-hexadecyl-, or N-dodecyl-1,3-diaminopropane. Preferably, dipropylene triamines such as N-hexadecyl- or N-octadecyl dipropylene triamine are used.

Compounds with formula (I) can also include polyamines with formula:

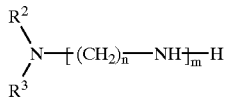

which corresponds to general formula (I) where $R^1$—Z— represents the group —$NR^2R^3$ where $R^2$ and $R^3$, which may be identical or different, have the same meaning as $R^1$ and are preferably each an alkyl radical containing 1 to 24, preferably 6 to 24, carbon atoms, $R^2$ and $R^3$ preferably including 12 to 32 carbon atoms between them; n is 2 to 4, preferably 3, and m is 1 to 4, preferably 2 to 4.

Specific compounds are N,N-diethyl 1,2-diaminoethane, N,N-diisopropyl 1,2-diaminoethane, N,N-dibutyl 1,2-diaminoethane, N,N-diethyl 1,4-diaminobutane, N,N-dimethyl 1,3-diaminopropane, N,N-diethyl 1,3-diaminopropane, N,N-dioctyl 1,3-diaminopropane, N,N-didecyl 1,3-diaminopropane, N,N-didodecyl 1,3-diaminopropane, N,N-ditetradecyl 1,3-diaminopropane, N,N-dihexadecyl 1,3-diaminopropane, N,N-dioctadecyl 1,3-diaminopropane, and specific preferred compounds are N,N-didodecyl dipropylene triamine, N,N-ditetradecyl dipropylene triamine, N,N-dihexadecyl dipropylene triamine and N,N-dioctadecyl dipropylene triamine.

Clearly, one or more compounds with formula (I) could be used without departing from the scope of the invention.

Dicarboxylic compounds which are condensed with a compound with formula (I) as defined above are more particularly selected from maleic anhydride, alkylmaleic anhydrides, for example methylmaleic (or citraconic) anhydride, or from the alkenyl succinic anhydrides, for example those obtained by the action of at least one olefin, preferably a linear olefin (containing, for example, 10 to 32 carbon atoms) on maleic anhydride. Specific examples are n-octadecenyl succinic anhydride or dodecenyl succinic anhydride. Clearly, mixtures of two (or more) of these compounds can be used.

Instead of the anhydrides described above, their corresponding dicarboxylic acids can be used, as well as their low alkyl diesters (such as the methyl, ethyl, propyl or butyl esters).

Primary amines with formula (I) are generally used in a concentration of 0.3 to 0.8 moles, preferably 0.4 to 0.7 moles per mole of dicarboxylic compound.

Condensation of compounds with formula (I) with dicarboxylic compounds (for example dicarboxylic acids, esters or preferably anhydrides) can be carried but without a solvent, but preferably a hydrocarbon solvent is used which has a boiling point of between 70° C. and 250° C., more particularly an aromatic or naphtheno-aromatic hydrocarbon, for example: toluene, a xylene, diisopropylbenzene or a petroleum cut with a suitable distillation range.

The additive compositions of the invention can be prepared using the following procedure: the compound with formula (I) is gradually introduced into a reactor containing the dicarboxylic compound at a temperature of between 30° C. and 80° C. The temperature is then raised to 120° C.–200° C. to eliminate the volatile products formed (water or alcohols), either by entrainment in an inert gas stream, or by azeotropic distillation with the selected solvent: the dry matter content is, for example, 40% to 70%, more frequently about 60%.

The reaction time, following addition of the reactants, is, for example, between 1 and 8 hours, preferably between 3 and 6 hours.

The additives of the invention are of particular importance in reducing settling of paraffins in petroleum middle distillates (in particular gas oils).

While the mechanism of the action of these additives on the sedimentation rate of paraffin crystals in middle distillates has not yet been fully explained, a substantial reduction in the settling of paraffins is observed in middle distillates treated with these additives when added in concentrations of, for example, 20 to 2000 grams per tonne (g/t) of middle distillate. Preferably, the concentration is 100 to 2000 g/t.

Remarkably, the additives of the invention which can inhibit n-paraffin sedimentation in middle distillates at rest also inhibit corrosion of metallic surfaces in contact with these distillates.

Within the additive concentration range, 20 g to 2000 g/t, a reduction of up to 100% in the proportion of paraffin sediment can be seen under the test conditions described in EP-B-0 071 513 and also under conditions which are more severe by 5° C. to 10° C. In addition, a substantial anticorrosive effect is observed, in particular with ferrous metals.

The middle distillate compositions of the invention can be formed by adding the additives directly to the middle distillate in a simple mixing operation.

However, it is often advantageous to introduce them in the form of "mother solutions" which are prepared in the solvents described above. The "mother solutions" can, for example, contain 20% to 60% by weight of additives.

The petroleum middle distillate compositions (for example gas oils) of the invention can also contain other additives, in particular other additives for improving low temperature quality, for example additives which reduce the pour point and additives which reduce the limiting filter temperature of the middle distillates (for example gas oils).

The present invention also relates to the use of at least one compound with formula (I):

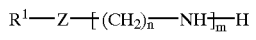

where Z, $R^1$, n and m have the definitions given above, in a proportion of 20 to 2000 parts per million of the, total composition weight, as an additive which reduces the sedimentation rate of paraffins in the hydrocarbon composition consisting of a major proportion of a hydrocarbon middle distillate containing paraffins. It also concerns the use of at least one compound with general formula (I) above in a proportion of 20 to 2000 parts per million of the total composition weight, as an anti-corrosion additive in a hydrocarbon composition consisting of a major proportion of a hydrocarbon middle distillate containing paraffins.

In this context, at least one compound with formula (I) consisting of at least one polyamine with one of the following formulae can advantageously be used:

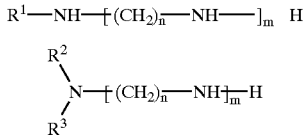

where $R^1$, $R^2$, $R^3$, n and m have the definitions given above.

The following examples illustrate the invention but are not in any way limiting.

EXAMPLE 1 (comparative)

2700 g of a commercial polyamine (containing a mixture of about 27% of palmityl 1,3-diaminopropane and about 70% of stearyl 1,3-diaminopropane, said mixture having an equivalent of 370 g of the primary amine group) and 2700 g of xylene were introduced into a 20 l reactor provided with a good stirring system. The amine was dissolved at 50° C. then cooled to 30° C., and a solution of 699 g of maleic anhydride dissolved in 1050 g of xylene was added, keeping the temperature below 40° C.; the addition took one hour, followed by heating for 3 hours at the reflux temperature of xylene. The temperature inside the reactor was 144° C., and 157 g of water was eliminated, corresponding to 128 g of water of reaction and 29 g of water contained in the starting amine; at the end of the reaction, 500 g of xylene was distilled to obtain a solution containing 50% by weight of additive I in xylene.

Additive I was analysed after evaporating off the solvent. The average molecular weight, measured using tonometry, was 1800. The infra-red absorption spectrum showed the existence of imide bands at 1700 and 1780 $cm^{-1}$, secondary amide at 1635 and 1560 $cm^{-1}$ and secondary amine at 3300 $cm^{-1}$. This additive was that described in Example 1 of EP-B-0 071 513.

EXAMPLE 2

Example 1 was repeated, using N-stearyl dipropylene triamine as the amine at a concentration of 0.75 moles of amine per mole of anhydride. The reactor was maintained at the reflux temperature of the xylene for 3 hours 30 minutes, following which there was no further elimination of water. The quantity of xylene was adjusted to obtain a solution of 50% by weight of additive II in xylene.

The additive was analysed after evaporating off the solvent. The average molecular weight, measured using tonometry, was 1600. The infra-red absorption spectrum showed the existence of imide bands at 1700 and 1780 $cm^{-1}$, secondary amide at 1635 and 1560 $cm^{-1}$ and secondary amine at 3300 $cm^{-1}$.

EXAMPLE 3

Example 2 was repeated, using N-stearyl dipropylene triamine as the amine and N-octadecenyl succinic anhydride as the anhydride at a concentration of 0.70 moles of amine per mole of anhydride. The reactor was maintained at the reflux temperature of the xylene for 4 hours, following which there was no further elimination of water. The quantity of xylene was adjusted to obtain a solution of 50% by weight of additive III in xylene.

The additive was analysed after evaporating off the solvent. The average molecular weight, measured using tonometry, was 1700. The infra-red absorption spectrum showed the existence of imide bands at 1700 and 1780 $cm^{-1}$, secondary amide at 1635 and 1560 $cm^{-1}$ and secondary amine at 3300 $cm^{-1}$.

EXAMPLE 4

Example 2 was repeated, using N-stearyl dipropylene triamine as the amine and N-octadecenyl succinic anhydride as the anhydride at a concentration of 0.5 moles of amine per mole of anhydride. The reactor was maintained at the reflux temperature of the xylene for 3 hours, following which there was no further elimination of water. The quantity of xylene was adjusted to obtain a solution of 50% by weight of additive IV in xylene.

Additive IV was analysed after evaporating off the solvent. The average molecular weight, measured using tonometry, was 1600. The infra-red absorption spectrum showed the existence of imide bands at 1700 and 1780 $cm^{-1}$, secondary amide at 1635 and 1560 $cm^{-1}$ and secondary amine at 3300 $cm^{-1}$.

EXAMPLE 5

The inhibiting action of additive I and additives II to IV of the invention were tested on the sedimentation of n-paraffins crystallizing in two commercial winter gas oils, the characteristics of which are given in Table I below:

TABLE I

| | Commercial gas oil No 1 | Commerical gas oil No 2 |
|---|---|---|
| Density at 15° C. | 0.844 | 0.843 |
| Distillation ASTM D 86-67 | | |
| Initial boiling pt | 172 | 166 |
| 5% | 200 | 190 |
| 10% | 213 | 199 |
| 20% | 231 | 214 |
| 30% | 246 | 228 |
| 40% | 260 | 242 |
| 50% | 273 | 257 |
| 60% | 286 | 269 |
| 70% | 300 | 285 |
| 80% | 314 | 305 |
| 90% | 332 | 336 |
| 95% | 343 | 359 |
| Cut point | 359 | 373 |
| % n-paraffins | 10.1 | 10.0 |
| Cloud point | −6 | −6 |
| LFT | −15 | −16 |
| Pour point | −27 | −30 |

The commercial gas oils contained 500 ppm by weight of an ethylene-vinyl acetate (EVA) pour point improver.

Two 250 $cm^3$ test tubes were filled with gas oil No 1. No additive was introduced into the first test tube. 0.1% by weight of one of the additives was introduced into the second test tube.

The two test tubes were hermetically sealed then allowed to stand in a cold room at −15° C. for 24 hours. After 24 hours, the amount of paraffin sediment precipitated out was expressed by the volumes of the different phases (sediment, slightly cloudy phase, cloudy phase, clear or limpid phase) in the test tube.

The results are shown in Tables II, IV and VI below.

The same test was carried out with gas oil No 2, at −20° C. for 24 hours. The results are shown in Tables III, V and VII below.

The quality of the upper phase determines the anti-sedimentation efficiency of the product: if the upper phase is cloudy, a high proportion of the paraffins has remained in solution. When the upper phase is clear, almost the whole of the paraffins has sedimented. When the upper phase is slightly cloudy, the anti-sedimentation efficiency is intermediate.

Regarding the quantity of paraffin sediment: the more the upper phase is deparaffined, the denser the sediment phase, which renders the gas oil difficult to pump. The quantities of paraffin sediments can only be compared if they have equivalent densities, i.e., if the upper phases are of the same nature.

Tables II and III concern the results obtained with additive I. Tables IV and V concern the results obtained with additive II. Tables VI and VII concern the results obtained with additives III and IV.

TABLE II

| Test tube No 1 Commercial gas oil No 1, untreated | Test tube No 2 Commercial gas oil No 2, + additive I |
|---|---|
| 50 ml sediment + 200 ml clear | 100 ml sediment + 150 ml slightly cloudy |

TABLE III

| Test tube No 1 Commercial gas oil No 2, untreated | Test tube No 2 Commercial gas oil No 2, + additive I |
|---|---|
| 60 ml sediment + 190 ml clear | 70 ml sediment + 180 ml clear |

It can be seen that additive I exemplified in EP-B-0 071 513 for its anti-sedimentation effectiveness at −10° C., is less effective at −15° C. and ineffective at −20° C.

TABLE IV

| Test tube No 1 Commercial gas oil No 1, untreated | Test tube No 2 Commercial gas oil No 1, + additive I |
|---|---|
| 50 ml sediment + 200 ml clear | 55 ml sediment + 195 ml slightly cloudy |

TABLE V

| Test tube No 1 Commercial gas oil No 2, untreated | Test tube No 2 Commercial gas oil No 2, + additive I |
|---|---|
| 60 ml sediment + 190 ml clear | 80 ml sediment + 170 ml slightly cloudy |

The anti-sedimentation effectiveness of additive II is higher than that of additive I, particularly at −20° C.

TABLE VI

| Test tube No 1 Gas oil No 1, untreated | Test tube No 2 Gas oil No 1, + additive III | Test tube No 3 Gas oil No 1, + additive IV |
|---|---|---|
| 50 ml sediment + 200 ml clear | 40 ml sediment + 210 ml cloudy | 2 ml sediment + 248 ml cloudy |

TABLE VII

| Test tube No 1 Gas oil No 2, untreated | Test tube No 2 Gas oil No 2, + additive III | Test tube No 3 Gas oil No 2, + additive IV |
|---|---|---|
| 60 ml sediment + 190 ml clear | 110 ml sediment + 140 ml cloudy | 10 ml sediment + 240 ml cloudy |

Better paraffin dispersion was obtained with additive III compared with additive II, but the ratio of reactants is an important factor in the anti-sedimentation effectiveness of additives: additive IV provides better homogeneity of the gas oils during cold storage.

EXAMPLE 6

The anti-corrosive effect of additives I to IV described above was tested.

The additive was used in gas oil No 1 and gas oil No 2 described above, in a concentration of 0.01% by weight.

The corrosion test consisted of studying corrosion by synthetic sea water on cylindrical steel or polished iron test pieces, in accordance with ASTM D 665, modified as follows: the temperature was 32.2° C. and the duration was 20 hours.

Untreated gas oil No 1 and gas oil No 2 produced test pieces which were 100% surface rusted and the two gas oils containing 0.01% by weight of one of the additives described above produced intact test pieces with 0% of rust.

What is claimed is:

1. A petroleum middle distillate composition comprising a major proportion of a petroleum middle distillate containing paraffins and having a distillation range of between 150° and 450° C., and a minor proportion, effective to reduce the rate of sedimentation of said paraffins, of at least one additive consisting essentially of a product having an average molecular weight of about 300 to 10,000 resulting from the reaction of (a) at least one aliphatic dicarboxylic compound selected from the group consisting of maleic anhydride, methylmaleic anhydride, n-octadecenyl succinic anhydride and dodecenyl succinic anhydride, with (b) a primary amine which is N-stearyl dipropylene triamine, wherein said primary amine (b) is used in a proportion of 0.3 to 0.7 moles per mole of said dicarboxylic compound (a) and said reaction is carried out at a temperature of 120° C. to 200° C., and continued until substantially all the water or alcohol, or mixture thereof formed during the reaction has evolved.

2. A composition according to claim 1, wherein the dicarboxylic compound (a) is maleic anhydride.

3. A composition according to claim 1, wherein the reaction is carried out in a hydrocarbon solvent with a boiling point between 70° C. and 250° C. and comprises mixing said dicarboxylic compound (a) with a said compound (b) at a temperature of 30° C. to 80° C. and heating the resulting mixture to a temperature of 120° C. to 200° C. for a period of 1 to 8 hours.

4. A composition according to claim 1, wherein the middle distillate is a gas oil cut having a distillation range from an initial boiling point of 160° C. to 190° C. to a cut point of 350° C. to 390° C.

5. A composition according to claim 1, wherein the proportion of said additive is 20 to 2000 grams per tonne of middle distillate.

6. A composition according to claim 1, wherein 0.4 to 0.7 moles of (b) are used per mole of(a).

7. A composition according to claim 1, wherein the aliphatic dicarboxylic compound is maleic anhydride or methyl maleic anhydride.

8. A composition according to claim 1, wherein the aliphatic dicarboxylic compound is methyl maleic anhydride.

9. A method of reducing the sedimentation rate of paraffins in a petroleum middle distillate containing paraffins and having a distillation range (ASTM D 86–67) of between 150° C. and 450° C., comprising introducing into the middle distillate a minor proportion of at least one additive effective to reduce the rate of sedimentation of said paraffins, said additive consisting essentially of a product having an average molecular weight of about 300 to 10000 resulting from the reaction of at least one aliphatic dicarboxylic compound (a) selected from the group consisting, maleic anhydride, methylmaleic anhydride, n-octadecenyl succinic anhydride and dodecenyl succinic anhydride, with (b) at least one primary amine which is N-stearyl dipropylene triamine, said primary amine (b) being used in a proportion of 0.3 to 0.7 moles per moles of said dicarboxylic compound (a); and said reaction being carried out at a temperature of 120° C. to 200° C., and being continued until all the volatile products consisting essentially of water or alcohol or a mixture thereof formed during the reaction have evolved.

10. A method according to claim 9, wherein the additive used results from the reaction of 0.4 to 0.7 mols of compound (b) per mole of compound (a).

11. A method according to claim 9, further comprising subjecting middle distillate containing additive to a temperature as low as −15° C.

12. A method according to claim 9, further comprising subjecting middle distillate containing additive to a temperature as low as −20° C.

13. A method according to claim 9, wherein the aliphatic dicarboxylic compound is maleic anhydride or methyl maleic anhydride.

14. A method according to claim 9, wherein the aliphatic dicarboxylic compound is methyl maleic anhydride.

15. A method according to claim 9, wherein the proportion of said additive is 20 to 2000 grams per tonne of middle distillate.

* * * * *